US007357467B2

(12) United States Patent
Lee

(10) Patent No.: US 7,357,467 B2
(45) Date of Patent: Apr. 15, 2008

(54) DOOR ASSEMBLY FOR USE IN A HOME APPLIANCE

(75) Inventor: Jae Hyuk Lee, Busan (KR)

(73) Assignee: LG Electronics Inc., Seoul (KR)

( * ) Notice: Subject to any disclaimer, the term of this patent is extended or adjusted under 35 U.S.C. 154(b) by 378 days.

(21) Appl. No.: 11/030,281

(22) Filed: Jan. 7, 2005

(65) Prior Publication Data

US 2005/0285491 A1 Dec. 29, 2005

(30) Foreign Application Priority Data

May 20, 2004 (KR) ..... 10-2004-0035807

(51) Int. Cl.
*E05B 15/00* (2006.01)

(52) U.S. Cl. ..... 312/328; 16/444; 16/422

(58) Field of Classification Search ..... 411/178, 411/388, 389, 401; 49/460; 312/405, 348.6, 312/326–329; 403/256, 258, 260; 16/415, 16/422, 413, 444
See application file for complete search history.

(56) References Cited

U.S. PATENT DOCUMENTS

| | | | | | |
|---|---|---|---|---|---|
| 1,418,095 | A | * | 5/1922 | Ringer | 16/419 |
| 1,599,924 | A | * | 9/1926 | Sanborn | 16/444 |
| 1,734,340 | A | * | 11/1929 | Overton | 248/163.1 |
| 2,282,412 | A | * | 5/1942 | Wallace | 16/436 |
| 2,498,139 | A | * | 2/1950 | Simjian | 248/467 |
| 2,576,511 | A | * | 11/1951 | Jewett | 16/402 |
| 2,815,997 | A | * | 12/1957 | Korb | 52/584.1 |
| 3,017,657 | A | * | 1/1962 | Herbert | 16/413 |
| 3,389,666 | A | * | 6/1968 | Schultze-Bonatz | 108/17 |
| 3,393,423 | A | * | 7/1968 | Adams | 16/444 |
| 3,766,598 | A | * | 10/1973 | Roberts | 16/444 |
| 4,097,061 | A | * | 6/1978 | Dietlein | 280/607 |
| 4,116,573 | A | * | 9/1978 | Fuchs | 403/264 |
| 4,912,809 | A | * | 4/1990 | Scheuer | 16/413 |
| 4,972,545 | A | * | 11/1990 | Ozagir et al. | 16/414 |
| 5,358,326 | A | * | 10/1994 | Cherry et al. | 312/405 |
| 5,810,502 | A | * | 9/1998 | Reitz et al. | 403/257 |
| 2003/0056334 | A1 | * | 3/2003 | Finkelstein | 16/436 |

FOREIGN PATENT DOCUMENTS

| | | | |
|---|---|---|---|
| CN | 1778259 | * | 5/2006 |
| WO | 2005/084517 | * | 9/2005 |

* cited by examiner

*Primary Examiner*—Janet M. Wilkens
(74) *Attorney, Agent, or Firm*—McKenna Long & Aldridge LLP

(57) ABSTRACT

A door assembly is made up of a door provided in a cabinet of a home appliance, such as a dishwasher, and a door handle for operating the door. The door assembly includes a door, installed in the cabinet, having an exterior surface; a door handle, affixed to the door at the exterior surface of the door, for manually operating the door; and at least one door handle coupler, fixed to the door handle and detachably fixed to the door. The door handle coupler has a pair of axially arranged coupling devices, including a first coupling device for fixing the at least one door handle coupler to the door handle, and a second coupling device for detachably coupling the at least one door handle coupler with the door. The door handle is affixed to the door by receiving an insertion of the first coupling device to a predetermined depth. The door has an interior surface, opposing the exterior surface, for preventing an escape of the second coupling device. The door assembly is particularly adapted for use in a dishwasher.

45 Claims, 4 Drawing Sheets

DOOR ASSEMBLY FOR USE IN A HOME APPLIANCE

This application claims the benefit of Korean Application No. 10-2004-0035807 filed on May 20, 2004, which is hereby incorporated by reference.

BACKGROUND OF THE INVENTION

1. Field of the Invention

The present invention relates to a door assembly comprised of a door provided in a cabinet of a home appliance and a door handle for operating the door, and more particularly, to a door assembly in which a door handle coupler is fixed to the door handle at one end and is detachably coupled with the door at the other end.

2. Discussion of the Related Art

A home appliance generally comprises a plurality of outer panels forming a cabinet for housing the inner workings of the home appliance, each panel largely constructing one face of the cabinet. A door, operated by the user, provides access to the interior of the home appliance. For functional and aesthetic reasons, the door is installed flush with one face of the cabinet, to form at least a portion of the cabinet face, and is manually operated by a door handle fixed to an exterior surface of the door.

The door may be provided to any face of the cabinet and may be coupled to the door handle at one or more sites. Door handles having a long handle grip (gripping surface) are generally provided for operating large doors, i.e., doors occupying large areas of the cabinet face, in which case there are at least two coupling sites (handle bases). The door handle for such a door typically includes a handle grip as a bar separated from the door to allow the user's hand to grasp the door handle at a point along the bar between the coupling sites. A horizontally oriented bar is typically provided to a door opened by an upward or downward pulling action, and a vertically oriented bar is typically provided to a door opened by a pulling action that swings the door to the left or right.

As an exemplary home appliance, FIGS. 1A and 1B illustrate a contemporary dishwasher in which a door assembly 200, including a door 210 and a door handle 220, is provided in a forward surface of a cabinet 100 forming an exterior of the dishwasher. The cabinet 100 includes a top cover 110 and a front panel 120 and has an interior space S for washing dishes placed on upper and lower racks 130 and 140. The door assembly 200 is installed to be substantially flush with an exterior surface of the front panel 120 and opens to provide access to the interior space S. In doing so, the door handle 220, which is coupled tightly to the door 210, is pulled downward, to allow the upper and lower racks 130 and 140 to be withdrawn and thereby accessed.

Meanwhile, conventional threaded coupling means, which are tightened during assembly, include a nut-and-bolt combination and screws (e.g., wood or sheet metal screws) that have self-tapping threads to be driven into various materials. Repeated cycles of tightening and loosening are enabled by the nut-and-bolt combination, but the nut and/or bolt tends to become loosened over time, weakening their engagement (coupling). A driven screw fixed, for example, in a material forming the door handle 210, may offer an improved engagement or more enduring coupling but prohibits repeated cycles of tightening and loosening, since the material in which the screw is fixed is inherently destroyed by the fixing action.

Therefore, in coupling the door handle 220 to the door 210, structural strength and integrity of the door assembly 220, as well as its ease of assembly and disassembly, should be considered. That is, the structure of the door assembly should allow numerous cycles of assembly-disassembly-reassembly, for example, for reworking during the manufacture of the home appliance or for making repairs after its sale, whereby the door assembly's original structural strength and integrity are always maintained. Thus, to promote the manufacture of a home appliance having a door assembly as described above, the door assembly should have a structure that facilitates the manufacture of the assembly's components and simplifies their assembly, disassembly, and reassembly, while preventing damage to or structural degradation of the door or door handle even after numerous cycles of assembly-disassembly-reassembly.

SUMMARY OF THE INVENTION

Accordingly, the present invention is directed to a door assembly that substantially obviates one or more problems due to limitations and disadvantages of the related art.

An object of the present invention is to provide a door assembly, which promotes the manufacture of a home appliance having a cabinet in which the door assembly is installed.

Another object of the present invention is to provide a door assembly, which facilitates the manufacture of assembly components of the door assembly.

Another object of the present invention is to provide a door assembly comprised of a door and a door handle, which facilitates the assembly, disassembly, and reassembly of the door handle with respect to the door.

Another object of the present invention is to provide a door assembly comprised of a door and a door handle, which prevents damage to or structural degradation of the door or door handle, even after repeated cycles of assembly, disassembly, and reassembly.

Another object of the present invention is to provide a door assembly comprised of a door and a door handle, which enables a simple replacement of the door handle if the door handle is somehow irreparably damaged.

Another object of the present invention is to provide a door assembly, in which the original structural strength and integrity of the door assembly is maintained, without abrasion or undue wear of assembly components, even after repeated assembly, disassembly, and reassembly.

Another object of the present invention is to provide a door assembly comprised of a door and a door handle, which provides an enduring coupling of the door handle to the door, while enabling repeated tightening and loosening of a threaded coupling means.

Another object of the present invention is to provide a home appliance, such as a dishwasher, adopting any one of the above door assemblies.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages in accordance with the purpose of the invention as embodied and broadly described herein, there is provided a door assembly for use in a home appliance having a cabinet. The door assembly comprises a door, installed in the cabinet, having an exterior surface; a door handle, affixed to the door at the exterior surface of the door, for manually operating the door; and at least one door handle coupler, fixed to the door handle and detachably coupled with the door, the at least one door handle coupler having a pair of axially arranged coupling means. The pair of axially arranged coupling means comprises a first coupling means for fixing the at least one door handle coupler to the door handle and a second coupling means for detachably coupling the at least one door handle coupler with the door. The door handle is affixed to the door by receiving an insertion of the first coupling means of the door handle coupler to a predetermined depth. Meanwhile, the door has an interior surface, opposing the exterior surface, for preventing an escape of the second coupling means of the door handle coupler. The door handle comprises at least one handle base, integrally formed with the door handle, for abutting against the door at the exterior surface of the door, and the at least one handle base has a coupling recess for receiving the insertion of the first coupling means of the at least one door handle coupler.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1B:
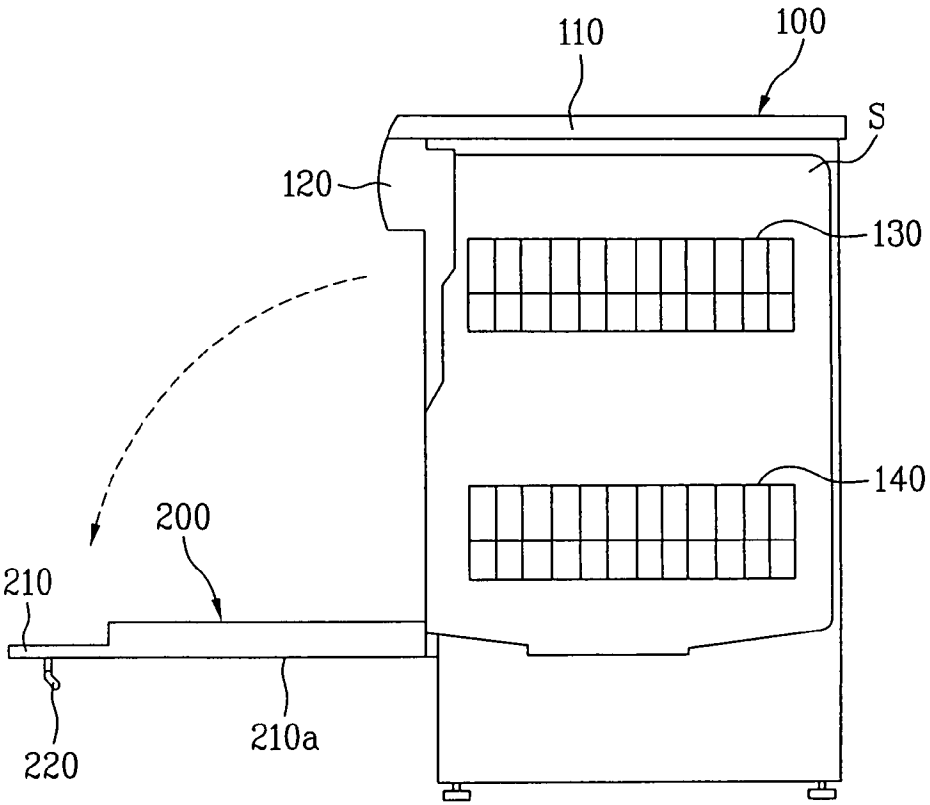
FIG. 1B Related Art
FIGS. 1A and 1B are schematic side views of a general home appliance having a door assembly, respectively illustrating closed and opened states of the door assembly.
Figure 1A:
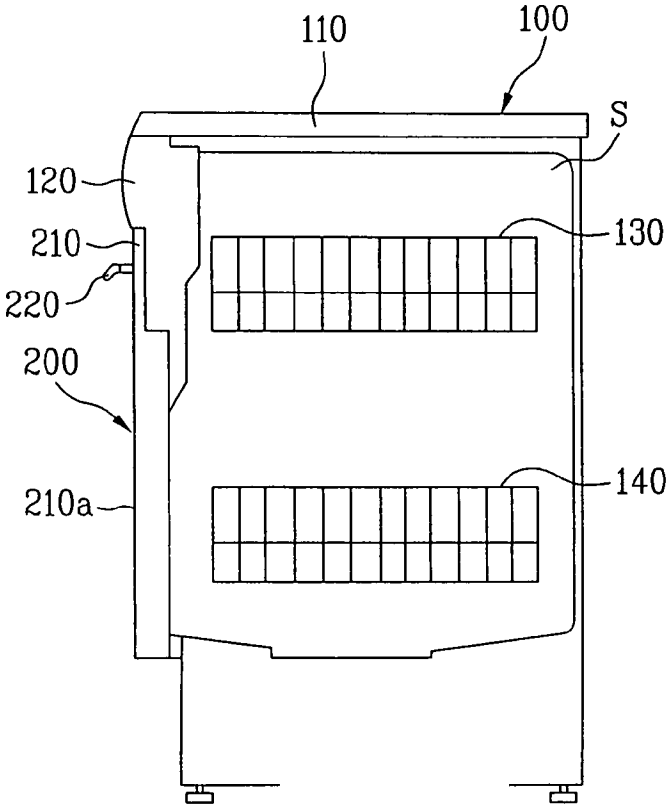
FIG. 1A Related Art
Figure 2:
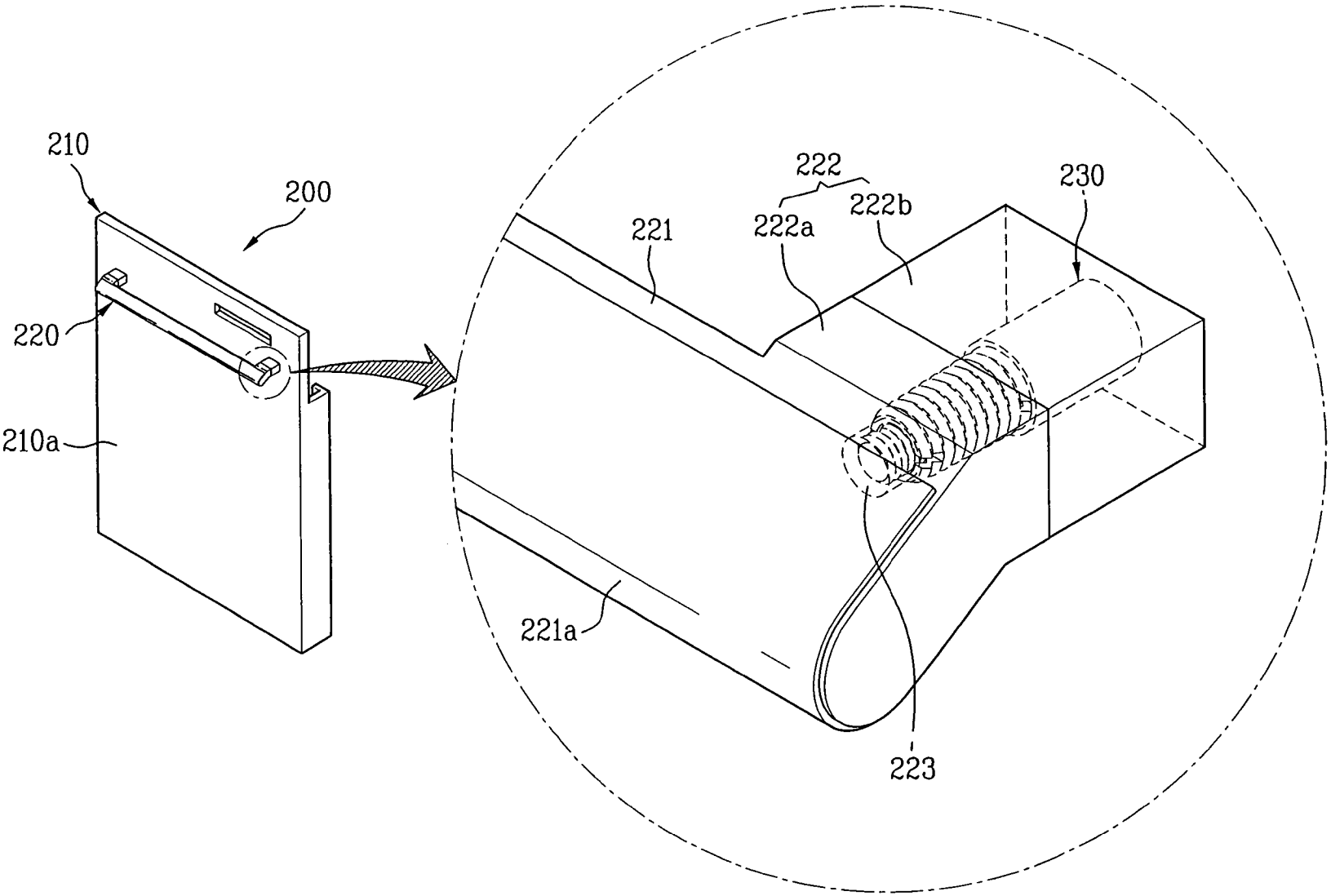
FIG. 2 is a perspective view of a door assembly according to the present invention, highlighting a door handle coupler according to a preferred embodiment.

Referring to FIG. 2, a door assembly 200 according to the present invention essentially comprises a door 210, a door handle 220, and a door handle coupler 230. In the preferred embodiment of the present invention, as shown in FIG. 2, the door handle 220 includes two handle bases 222, to be described later, each having a coupling recess 223 for receiving a mating insertion of one door handle coupler 230 to a predetermined depth.

The door 210, for providing access to the interior of the cabinet 100 by manually operating the door handle 220 to open and close the door, has an exterior surface 210*a* to which the door handle is affixed at two coupling sites corresponding to a predetermined positioning of the handle bases 222. The door 210 is installed in the cabinet 100 such that the exterior surface 210*a* of the door is substantially flush with the exterior surface of the cabinet. The door handle 220 is affixed to the door 210, to protrude from the exterior surface 210*a* and thereby enable the manual operation of the door. Each door handle coupler 230 includes a pair of axially arranged coupling means, including a first coupling means for fixing one door handle coupler to the door handle 220 and a second coupling means for detachably coupling the door handle coupler with the door 210.

Thus, the door assembly 200 according to the present invention includes at least one door handle coupler 230, fixed to the door handle 220 and detachably coupled with the door 210. That is, after assembly, the door handle coupler 230 can be considered as being permanently coupled to the door handle 220 at one end via the first coupling means and as being coupled to the door 210 to allow disassembly and reassembly at the other end via the second coupling means.

In accordance with the function of the first coupling means, the door handle 220 is fixed to the door 210 by receiving an insertion of one end of each door handle coupler 230, to reach a predetermined depth within each handle base 222. At the same time, it should be appreciated that the door 210 has an interior surface (not shown) disposed in direct opposition the exterior surface 210*a*. Thus, in accordance with the function of the second coupling means, the other end of each door handle coupler 230 is inserted through the door 210 and is anchored at the door's interior surface to prevent an escape of the door handle coupler.

In the embodiment of the present invention, the door handle 220 comprises two handle bases 222, for establishing a pair of coupling sites separated by a predetermined distance for supporting the door 210 under operation, each handle base having a predetermined length to allow the user to grasp the door handle; and a handle grip 221, formed as a horizontal bar running substantially parallel to the exterior surface 210*a* of the door and supportably connecting the handle bases, for providing a gripping surface separated from the exterior surface of the door. Each handle base 222 includes a handle foot 222*a*, integrally formed with the handle grip 221, for providing a coupling base; and a handle extension 222*b*, disposed between the door 210 and the corresponding handle foot, for completing the predetermined length of the handle base. An outer surface of the handle grip 221 has a handle cover 221*a* for providing the handle grip with a protective covering to guard against minor impacts. Here, the handle cover 221*a* is preferably formed of a metal, such as a stainless steel or aluminum, having a predetermined strength and offering corrosion-prevention properties.

Figure 3:
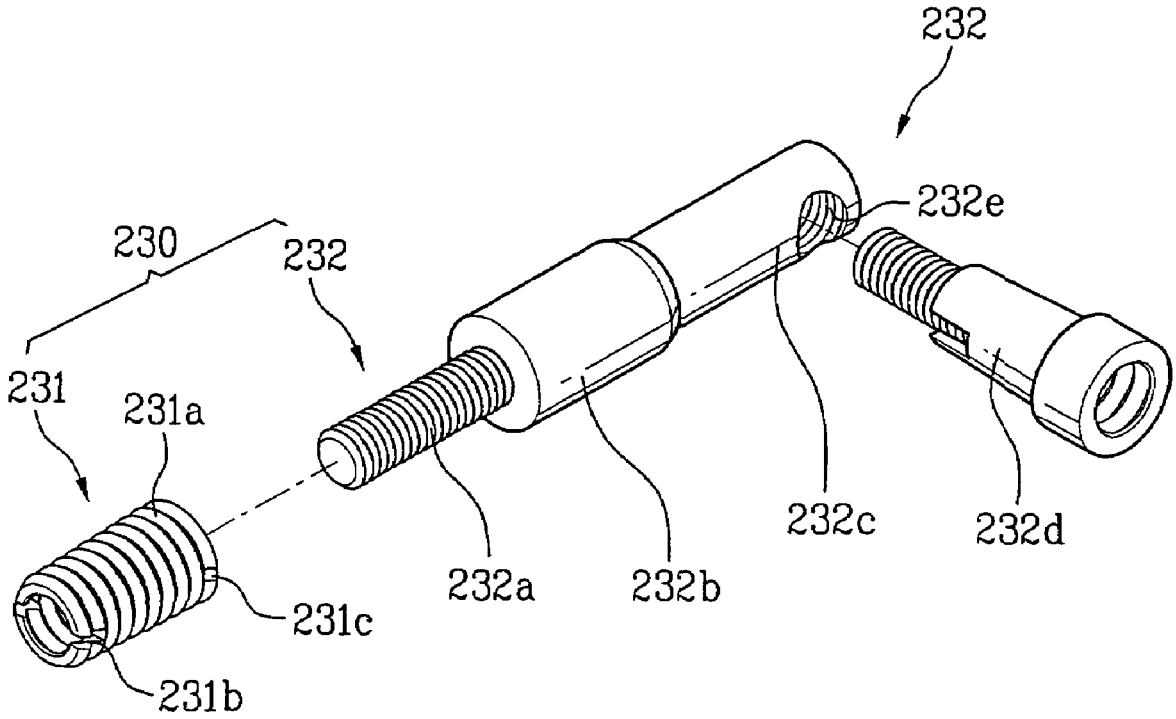
FIG. 3 is an exploded view of the door handle coupler of FIG. 2.

Referring to FIG. 3, the door handle coupler 230 of the present invention comprises a nut 231 having an inner surface on which female threads are formed and an outer surface for engaging with the coupling recess 223 of the handle base 222; and a bolt 232, having first and second ends axially disposed with respect to each other, for engaging with the female threads of the nut at the first end of the bolt and for detachably coupling with the door 210 at the second end of the bolt. The nut 231 is preferably formed of a plastic or metal having a predetermined strength, such that the nut exhibits a higher hardness than the material of the handle base 222. Male threads 232*a*, for receiving the female threads of the nut 231, are formed on the first end of the bolt 232.

In a preferred embodiment, the nut 231 has self-tapping male threads 231*a* formed on its outer surface. Preferably, one end of the outer surface of the nut 231 has a first tool groove 231*b*, e.g., a slot, for receiving a tool such as a driver or wrench for engaging the nut with the bolt. Similarly, a second tool groove 231*c* is preferably provided on the other end of the nut 231 so that, to engage the nut with the coupling recess 223, the self-tapping male threads 231*a* of the nut may cut into the material of the handle base 222 using a tool such as a driver or wrench. That is, the nut 231 simultaneously serves as a nut engaging with the bolt 232 and as a screw engaging with (driven into) the coupling recess 223.

The bolt 232 further comprises a bolt head 232*b*, formed at the first end of the bolt and having a larger diameter than the nut 231, for stopping the insertion of the first coupling means of the door handle coupler 230 at the predetermined depth; a bolt head extension 232*c*, integrally formed with the bolt head, extending from the exterior surface 210*a* of the door 210 to the door's interior surface; and an anchor 232*d*, connected to the bolt head extension, for capturing the second coupling means of the door handle coupler at the interior surface of the door.

In the preferred embodiment of the present invention, the anchor 232*d* is perpendicularly connected to the bolt head extension 232*c*, to capture the door handle coupler 230 at the interior surface of the door 210 and thereby prevent its escape outward through the door. The perpendicular connection is achieved by forming a threaded hole 232*e*, opening a lateral surface of the bolt head extension 232*c*, to receive and engage with a threaded distal end of the anchor 232*d*. As an alternative, a pin-and-socket combination may be employed, whereby a socket is formed in the bolt head extension 232*c* or anchor 232*d* and the opposing element, i.e., the bolt head extension or anchor, acts as a pin to be inserted into the socket to create a perpendicular connection. The interior surface of the door 210 may be concealed within the door itself, i.e., between the exterior surface 210*a* and an inward side (not shown) of the door, or may form part of the inward side of the door. The anchor 232*d* may be inserted and engaged with the threaded hole 232*e* via an edge surface of the door 210, thereby concealing the anchor, or may be accessible from the inward side of the door, in which case the bolt 232 may be simply comprised of a stud bolt receiving the nut 231 at one end and an anchoring nut (not shown) at the other end.

According to the present invention, the first coupling means of the door handle coupler 230 generally corresponds to the nut 231 and its engagement with the bolt 232 and the coupling recess 223, which fixes the door handle coupler to the door handle 220. Meanwhile, the second coupling means of the door handle coupler 230 generally corresponds to the bolt 232 and its engagement with the door 210.

Figure 4:
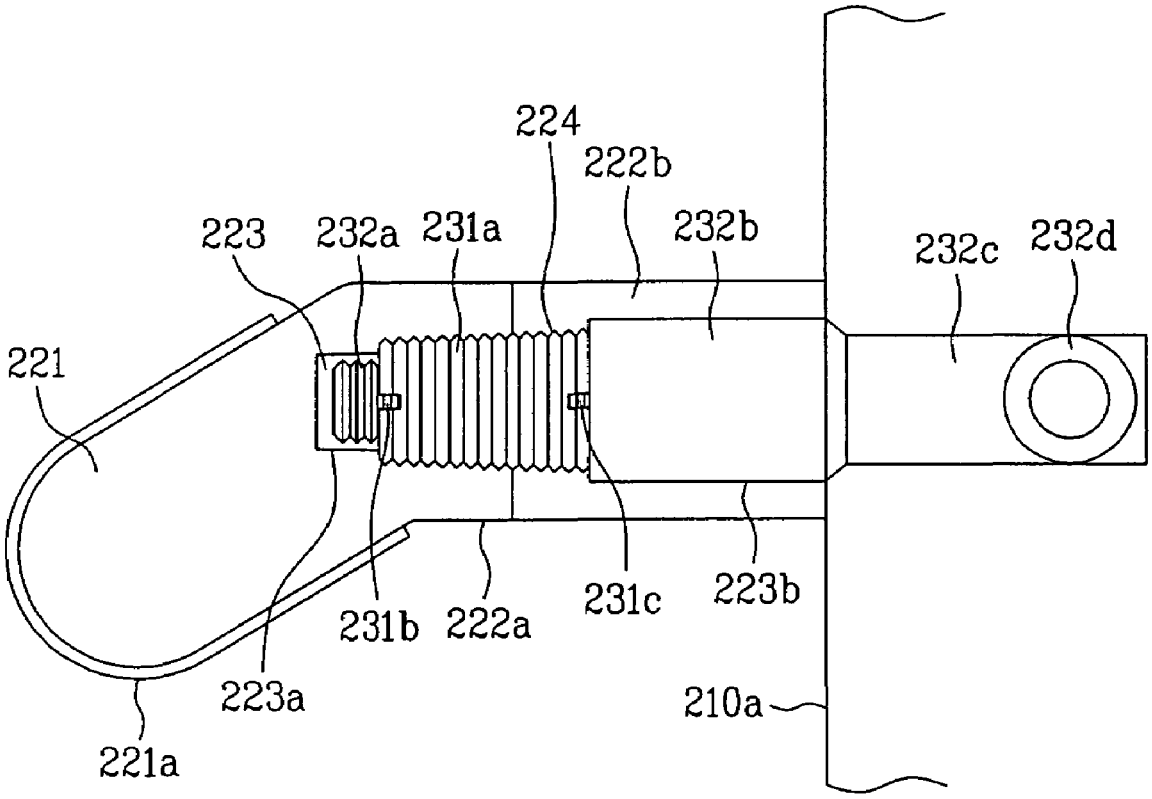
FIG. 4 is a cross-sectional side view of the door assembly of FIG. 2.

As shown in FIG. 4, to affix the door handle 220 to the door 210, the first coupling means of the door handle coupler 230 is inserted into the door handle, to a predetermined depth within the handle base 222, while being coupled with the door via the second coupling means. To receive this insertion, the coupler recess 223 is formed in each handle base 222 to receive a full-depth insertion of the door handle coupler 230, which is passed through the handle extension 222*b* and to a predetermined depth within the handle foot 222*a*, and to engage with the first coupling means of the door handle coupler 230.

According to the present invention, the coupling recess 223 formed in each handle base 222 has an inner wall forming a bolt well, composed of a deep bolt well 223*a* and a shallow bolt well 223*b*, and having a nut engaging surface 224 disposed substantially between the deep and shallow bolt wells. Thus, the bolt well of the coupling recess 223 is formed to receive a full-depth insertion of the bolt 232, such that, after the insertion of the bolt into the coupling recess, the first end of the bolt has no contact with the bolt well and the second end of the bolt fits firmly into the bolt well. Specifically, with the nut 231 fixed in the coupling recess 223 and the bolt 232 fully engaged with the nut, the male threads 232*a* have no contact with the inner wall of the coupling recess at the deep bolt well 223*a*, which is formed to have a sufficient diameter and depth for preventing an abrasion of the material of the handle base 222 if the bolt is repeatedly engaged and disengaged with the nut, and the bolt head 232*b* fits firmly against the inner wall of the coupling recess at the shallow bolt well 223*b*, to support the insertion of the bolt 232 into the handle base.

To engage the nut 231 with the coupling recess 223, and specifically to the nut engaging surface 224 thereof, the coupling recess is formed to have a pilot hole (not shown) for receiving the self-tapping male threads 231*a* of the nut. Formation of the pilot hole, which communicates at opposite ends with each of the deep and shallow wells 223*a* and 233*b* of the coupling recess 223, is based on the outer dimensions of the nut 231 and, after an engagement of the nut with the coupling recess, substantially corresponds to the nut engaging surface 224.

As an alternative, the nut 231 may be engaged with the coupling recess 223 of the handle base 222 by press-fitting the nut into the pilot hole, in which case there are no male threads 231*a* formed on the outer surface (nut engaging surface) of the nut. In any case, the nut 231 may be engaged with the bolt 232 before being engaged with the nut engaging surface 224 of the inner wall of the coupling recess 223 or may first be engaged with the nut engaging surface. Here, it should be appreciated that the first tool groove 231*b* is applicable when first engaging the nut 231 with the bolt 232 and the second tool groove 231*c* is applicable when first engaging the nut with the coupling recess 223 and that a simultaneous provision of both tool grooves is permissible but unnecessary.

Though the drawings show the axial length of the male threads 232*a* to be greater than the axial length of the nut 231, the nut could have the longer axial length, such that the first (threaded) end of the bolt 232 would terminate within the nut when fully inserted and engaged therewith. The present invention is satisfied if the coupling recess 223 has a sufficient depth and diameter for receiving a full-depth insertion of the male threads 232*a*, without resulting in any abrasion of inner walls of the coupling recess 223.

In the event that a vibration generated by an operation of the home appliance acts to loosen the door handle 220 with respect to the door 210, the bolt 232 remains firmly and fully engaged with the nut 231, and the door handle coupler 230 remains tightened. Thus, the door handle 220 remains firmly coupled to the door 210, since forces applied to the door handle for opening and closing the door continually tighten the bolt to recover any loss in the original state of the coupling between the door and the door handle. In other words, though the bolt 232 can be unscrewed from the nut 231, the nut, which is press-fitted to or screwed into the material of the coupling base 222 to be permanently fixed thereto, remains firmly coupled to the coupling base and cannot be unscrewed from the bolt, which is simultaneously anchored to the door 210. In doing so, there is no abrasion or undue wear of inner walls of the coupling recess 223, since the coupling recess includes the deep bolt well 223*a* communicating with the nut engaging surface 224, such that the male threads 232*a* of the bolt 232, even at full-depth insertion, never make direct contact with the material of the handle base 222.

As described above, the door assembly according to the present invention promotes the manufacture of a home appliance having a cabinet in which the door assembly is installed, such as a dishwasher, by facilitating the manufacture of assembly components of the door assembly, comprised of a door and a door handle, and thereby improves productivity. The door handle coupler, engaged with the coupling recess of at least one handle base in accordance with the present invention, facilitates the assembly, disassembly, and reassembly of the door handle with respect to the door, prevents damage to or structural degradation of the door or door handle, even after repeated cycles of assembly, disassembly, and reassembly, and enables a simple replacement of the door handle if the door handle is somehow irreparably damaged, to maintain the original structural strength and integrity of the door assembly, without abrasion or undue wear of the assembly components.

The door assembly according to the present invention is applicable to any home appliance having a cabinet for enclosing an interior space and including a door installed in the cabinet to provide access to the interior space. The door assembly illustrated in the accompanying drawings is particularly adapted to a dishwasher, though most other home appliances may adopt the present invention. For example, according to the number and positioning of the handle bases, a horizontally arranged handle may open a forwardly disposed door of a home appliance such as a dishwasher or oven by a downward pulling action or may open the upwardly disposed door of a home appliance such as a freezer or top-loading washer or dryer by an upward pulling action, and a vertically arranged handle may open a forwardly disposed door of a home appliance such as a refrigerator or front-loading washer or dryer by a pulling action that swings the door to the left or right. The home appliance adopting the door assembly of the present invention may be of any size, including toaster ovens and commercial freezers, and the door handle may be provided with a single handle base having a handle grip connected at one end only or may be provided with numerous handle bases having any number of handle grips connected variously to provide simultaneously a variety of alternative door handle gripping and operation. In doing so, a threaded coupling means can be used to couple the door handle 220 to the door 210 without weakening the coupling by repeated cycles of the tightening and loosening of the threaded coupling means.

It will be apparent to those skilled in the art that various modifications and variations can be made in the present invention. Thus, it is intended that the present invention cover the modifications and variations of this invention provided they come within the scope of the appended claims and their equivalents.

What is claimed is:

1. A door assembly for use in a home appliance having a cabinet, the door assembly comprising:

a door, having an exterior surface and an interior surface opposing the exterior surface;

a door handle, affixed to said door at the exterior surface of said door adapted to manually operate, wherein the door handle comprises at least one handle base, integrally formed with said door handle, to abut against said door at the exterior surface of said door, said at least one handle base having a coupling recess; and at least one door handle coupler, fixed to said door handle and detachably coupled with said door, said at least one door handle coupler, comprising:

a nut having an inner surface on which female threads are formed and an outer surface adapted to engage with the coupling recess of said at least one handle base, a bolt, having first and second ends axially disposed with respect to each other, said bolt engaging with said nut at the first end and detachably coupling with said door at the second end, wherein the first end of said bolt comprises male threads, having an axial length greater than an axial length of said nut, to receive the female threads of said nut, and the second end of said bolt comprises a bolt head adapted to stop the insertion of said nut of said at least one door handle coupler at a predetermined depth, and an anchor securing said bolt at the interior surface, wherein said door handle is affixed to said door by receiving an insertion of said nut of said at least one door handle coupler to the predetermined depth.

2. The door assembly as claimed in claim 1, wherein said at least one handle base has a predetermined length for allowing a user to grasp said door handle.

3. The door assembly as claimed in claim 1, wherein each of said at least one handle base is separated by a predetermined distance for supporting said door under operation.

4. The door assembly as claimed in claim 1, wherein said at least one handle base comprises:

a handle foot, integrally formed with said door handle, said handle foot adapted to receive the insertion of said nut of said at least one door handle coupler; and a handle extension, disposed between said handle foot and the exterior surface of said door, increasing a separation between said door handle and the exterior surface of said door.

5. The door assembly as claimed in claim 1, wherein said door handle further comprises:

a handle grip for providing a gripping surface separated from the exterior surface of said door, said handle grip formed as a bar running substantially parallel to the exterior surface of said door and supportably connected to said at least one handle base.

6. The door assembly as claimed in claim 5, wherein said door handle further comprises:

a handle cover, covering an outer surface of said handle grip, for preventing damage caused by minor impacts applied to said door handle.

7. The door assembly as claimed in claim 6, wherein said handle cover is formed of a metal.

8. The door assembly as claimed in claim 7, wherein the metal of said handle cover is one of stainless steel and aluminum.

9. The door assembly as claimed in claim 1, wherein said nut exhibits a higher hardness than a material of said at least one handle base.

10. The door assembly as claimed in claim 1, wherein said nut is formed of one of a plastic or a metal.

11. The door assembly as claimed in claim 1, wherein the coupling recess of said at least one handle base has an inner wall, formed to receive and engage with said at least one door handle coupler, the inner wall forming a bolt well for receiving an insertion of said bolt and having a nut engaging surface for engaging with the outer surface of said nut.

12. The door assembly as claimed in claim 11, wherein, after the insertion of said bolt into the bolt well of the coupling recess, the first end of said bolt has no contact with the bolt well and the second end of said bolt fits firmly into the bolt well.

13. The door assembly as claimed in claim 11, wherein the inner wall of the coupling recess forms a deep bolt well having a diameter larger than the first end of said bolt.

14. The door assembly as claimed in claim 13, wherein the inner wall having the nut engaging surface communicates with the deep bolt well.

15. The door assembly as claimed in claim 13, wherein the deep bolt well has a depth greater than the predetermined depth of the insertion of said bolt of said at least one door handle coupler.

16. The door assembly as claimed in claim 11, wherein the inner wall of the coupling recess forms a shallow bolt well having a diameter substantially equal to the second end of said bolt.

17. The door assembly as claimed in claim 11, wherein said nut has self-tapping male threads formed on its outer surface and wherein the nut engaging surface of the inner wall of the coupling recess is formed as a pilot hole to receive the self-tapping male threads of said nut.

18. The door assembly as claimed in claim 17, wherein the pilot hole has a diameter determined by outer dimensions of said nut.

19. The door assembly as claimed in claim 18, wherein said nut is engaged with said bolt before being engaged with the nut engaging surface of the inner wall of the coupling recess.

20. The door assembly as claimed in claim 17, wherein, after an engagement of said nut with the coupling recess, the pilot hole substantially corresponds to the nut engaging surface of the inner wall of the coupling recess.

21. The door assembly as claimed in claim 1, wherein said nut is engaged with the coupling recess of said at least one handle base by press-fitting.

22. The door assembly as claimed in claim 21, wherein said nut is engaged with said bolt before being engaged with the nut engaging surface of the inner wall of the coupling recess.

23. The door assembly as claimed in claim 1, wherein the outer surface of said nut has a tool groove for engaging said nut with the coupler recess.

24. The door assembly as claimed in claim 23, wherein the tool groove is formed at one end of said nut for receiving one of a driver and a wrench.

25. The door assembly as claimed in claim 1, wherein the outer surface of said nut has a tool groove for engaging said nut with said bolt.

26. The door assembly as claimed in claim 24, wherein the tool groove is formed at one end of said nut for receiving one of a driver and a wrench.

27. The door assembly as claimed in claim 1, wherein said bolt is comprised of a stud bolt.

28. The door assembly as claimed in claim 27, wherein the anchor is comprised of an anchoring nut.

29. The door assembly as claimed in claim 1, wherein the home appliance is a dishwasher.

30. A door assembly for use in a home appliance having a cabinet, the door assembly comprising:

a door, having an exterior surface and an interior surface opposing the exterior surface;

a door handle, affixed to said door at the exterior surface of said door, said door adapted to manually operate, wherein the door handle comprises at least one handle base, integrally formed with said door handle, to abut against said door at the exterior surface of said door, said at least one handle base having a coupling recess; and at least one door handle coupler, fixed to said door handle and detachably coupled with said door, said at least one door handle coupler, comprising:

a nut having an inner surface on which female threads are formed and an outer surface adapted to engage with the coupling recess of said at least one handle base, a bolt, having first and second ends axially disposed with respect to each other, said bolt engaging with said nut at the first end said detachably coupling with said door at the second end, wherein the first end of said bolt comprises male threads to receive the female threads of said nut, and the second end of said bolt comprises a bolt head adapted to stop the insertion of said nut of said at least one door handle coupler at the predetermined depth, wherein the bolt head is integrally formed with the male threads of said bolt and has an outer diameter larger than the outer surface of said nut, and an anchor securing said bolt at the interior surface, wherein said door handle is affixed to said door by receiving an insertion of said nut of said at least one door handle coupler to the predetermined depth.

31. The door assembly as claimed in claim 30, wherein the male threads of the first end of said bolt have an axial length greater than an axial length of said nut.

32. The door assembly as claimed in claim 30, wherein the male threads of the first end of said bolt have an axial length less than an axial length of said nut.

33. The door assembly as claimed in claim 30, wherein the coupling recess of said at least one handle base has an inner wall, formed to receive and engage with said at least one door handle coupler, the inner wall forming a bolt well for receiving an insertion of said bolt and having a nut engaging surface for engaging with the outer surface of said nut.

34. The door assembly as claimed in claim 30, wherein said nut is engaged with the coupling recess of said at least one handle base by press-fitting.

35. The door assembly as claimed in claim 30, wherein the home appliance is a dishwasher.

36. A door assembly for use in a home appliance having a cabinet, the door assembly comprising:

a door, having an exterior surface and an interior surface opposing the exterior surface;

a door handle, affixed to said door at the exterior surface of said door adapted to manually operate said door, wherein the door handle comprises at least one handle base, integrally formed with said door handle, to abut against said door at the exterior surface of said door, said at least one handle base having a coupling recess; and at least one door handle coupler, fixed to said door handle and detachably coupled with said door, said at least one door handle coupler, comprising:

a nut having an inner surface on which female threads are formed and an outer surface adapted to engage with the coupling recess of said at least one handle base, a bolt, having first and second ends axially disposed with respect to each other, said bolt engaging with said nut at the first end and detachably coupling with said door at the second end, the first end of said bolt comprising:

male threads for receiving the female threads of said nut, and the second end of said bolt comprising:

an anchor securing the bolt at the interior surface, wherein the anchor is perpendicularly coupled to the second end of said bolt wherein said door handle is affixed to said door by receiving an insertion of said nut of said at least one door handle coupler to a predetermined depth, and wherein the anchor is coupled to the second end of said bolt via a threaded engagement means opposingly provided on each of the anchor and the second end of said bolt.

37. The door assembly as claimed in claim 36, wherein the anchor is coupled to the second end of said bolt via a pin-and-socket combination opposingly provided on each of the anchor and the second end of said bolt.

38. The door assembly as claimed in claim 36, wherein the interior surface of said door is concealed within said door and wherein the anchor is coupled to the second end of said bolt via an edge surface of said door.

39. The door assembly as claimed in claim 38, wherein the anchor is disposed between the exterior surface of said door and an inward side of said door.

40. The door assembly as claimed in claim 36, wherein the anchor is accessible from an inward side of said door.

41. The door assembly as claimed in claim 36, the second end of said bolt further comprising:

a bolt head for stopping the insertion of said nut of said at least one door handle coupler at the predetermined depth; and a bolt head extension, integrally formed with the bolt head and connected with the anchor, extending from the exterior surface of said door to the interior surface of said door.

42. The door assembly as claimed in claim 41, wherein the anchor is perpendicularly coupled to the bolt head extension.

43. The door assembly as claimed in claim 36, wherein the coupling recess of said at least one handle base has an inner wall, formed to receive and engage with said at least one door handle coupler, the inner wall forming a bolt well for receiving an insertion of said bolt and having a nut engaging surface for engaging with the outer surface of said nut.

44. The door assembly as claimed in claim 36, wherein said nut is engaged with the coupling recess of said at least one handle base by press-fitting.

45. The door assembly as claimed in claim 36, wherein the home appliance is a dishwasher.

* * * * *